US008944683B2

(12) United States Patent
Hickerson

(10) Patent No.: US 8,944,683 B2
(45) Date of Patent: Feb. 3, 2015

(54) FISHTAIL FASTENER

(71) Applicant: Karen Hickerson, Denton, TX (US)

(72) Inventor: Karen Hickerson, Denton, TX (US)

( * ) Notice: Subject to any disclaimer, the term of this patent is extended or adjusted under 35 U.S.C. 154(b) by 195 days.

(21) Appl. No.: 13/694,473

(22) Filed: Dec. 5, 2012

(65) Prior Publication Data

US 2014/0150220 A1 Jun. 5, 2014

(51) Int. Cl.

| | |
|---|---|
| ***B65D 37/00*** | (2006.01) |
| ***A44B 11/16*** | (2006.01) |
| ***A44B 6/00*** | (2006.01) |

(52) U.S. Cl.

CPC . *A44B 11/16* (2013.01); *A44B 6/00* (2013.01); *Y10S 24/51* (2013.01)

USPC ..... 383/4; 56/1; 294/137; 294/141; 294/165; 294/219; 24/DIG. 51

(58) Field of Classification Search

USPC ..... 383/4, 71, 74; 24/594.1; 56/1; 294/150, 294/156, 165, 141, 137, 219

See application file for complete search history.

(56) References Cited

U.S. PATENT DOCUMENTS

| | | | | | |
|---|---|---|---|---|---|
| 290,198 | A * | 12/1883 | Armstrong | 24/625 |
| 623,193 | A * | 4/1899 | Valdettaro | 24/625 |
| 818,081 | A * | 4/1906 | Kislik | 16/326 |
| 1,695,592 | A * | 12/1928 | Kromer | 24/614 |
| 1,822,912 | A * | 9/1931 | Swanstrom | 24/695 |
| 2,766,797 | A * | 10/1956 | Cowen | 383/4 |
| 4,682,447 | A * | 7/1987 | Osborn | 52/3 |
| 6,267,504 | B1 * | 7/2001 | Screen | 383/4 |
| 2010/0178828 | A1 * | 7/2010 | Garrison | 442/295 |
| 2011/0041954 | A1 * | 2/2011 | Noonan | 141/316 |

* cited by examiner

*Primary Examiner* — Jack W Lavinder

(74) *Attorney, Agent, or Firm* — David G. Moore

(57) ABSTRACT

The invention disclosed herein is a fastener which is embedded into a sturdy fabric. Once embedded into a sturdy fabric the fastener may be joined making a bag which can be used to contain items such as yard debris, sporting equipment, and many other items. In another embodiment, the fastener may be embedded into a strap and used to secure items to trailers, boats, and cars or to securely bundle items such as sticks, firewood, baseball bats, hockey sticks, tools and the like. The invention disclosed herein is composed of a fastener spring and a fastener spring receiver embedded into the opposite corners of a sturdy fabric. The fastener spring consist of a spring from which two lateral struts extend. At the end of the lateral struts, circular stops are attached. The fastener spring receiver is rectangular. The lateral struts of the fastener spring are compressed and the circular stops are inserted into the spring receiver. The circular stops are designed to remain in the spring receiver until the lateral struts are again compressed to permit removal from the spring receiver of the circular stops. By this method the corners of a fabric may be joined by inserting the circular stops of the fastener spring into the opposite receiver forming a bag or container.

4 Claims, 7 Drawing Sheets

FISHTAIL FASTENER

CROSS-REFERENCE TO RELATED APPLICATIONS

This application seeks priority to and benefit of provisional patent application No. 61/630,353 filed on Dec. 9, 2011 which is incorporated herein by reference as if fully set forth.

STATEMENT REGARDING FEDERALLY SPONSORED RESEARCH OR DEVELOPMENT

No part of the invention disclosed herein was the subject of federally sponsored research or development.

THE NAMES OF THE PARTIES TO A JOINT RESEARCH AGREEMENT

None

REFERENCE TO A SEQUENCE LISTING

Not applicable.

BACKGROUND OF THE INVENTION

1. Field of the Invention

The field of the invention and related embodiments disclosed herein is fasteners which can connect sturdy fabrics of various sizes and shapes around objects to be contained or secured.

2. Description of the Prior Art

Various devices have been developed for fastening fabrics together so that the fabric can enclose various objects or secure objects and items for storage or transport. Common fasteners include: 1) a hook which attaches to a receiver, 2) a buckle type fastener, 3) a Velcro™ fastener, 4) an adjustable ratchet-type fastener, and many other type of fasteners. None of the available fasteners are physically imbedded in the fabric which is to be fastened about the objects or items, but are usually separate. Encasing the fastening components in fabric allows protection against areas or items which are prone to damage. Because the other fasteners are separate from the fabric which is intended to encase the object, the fasteners get lost or they require significant manipulation in order to work properly. Further, most fasteners are difficult or cumbersome to connect and disconnect. What is needed in the art is a fastener, physically embedded into sturdy fabric material which can easily be connected or single handedly disconnected and operates comfortably in the operators hand or fingers.

BRIEF DESCRIPTION OF THE PRESENT INVENTION

The invention and related embodiments disclosed herein is a fastener, physically embedded into sturdy fabric material which can easily be connected or single handedly disconnected and operates comfortably in the operators hand or fingers. Specifically, the invention and related embodiments disclosed herein consists of a spring shaped like a fishtail and a spring receiver for the fishtail spring, both of which are physically embedded at strategic locations into sturdy fabric. The sturdy fabric can be wrapped around the object or item to be moved and the fabric can be secured by insertion of the fishtail spring into the spring receiver.

BRIEF DESCRIPTION OF THE DRAWING/FIGURES

A better understanding of the present invention and related embodiments may be had by review of the following drawing/figures.

Figure 3A:
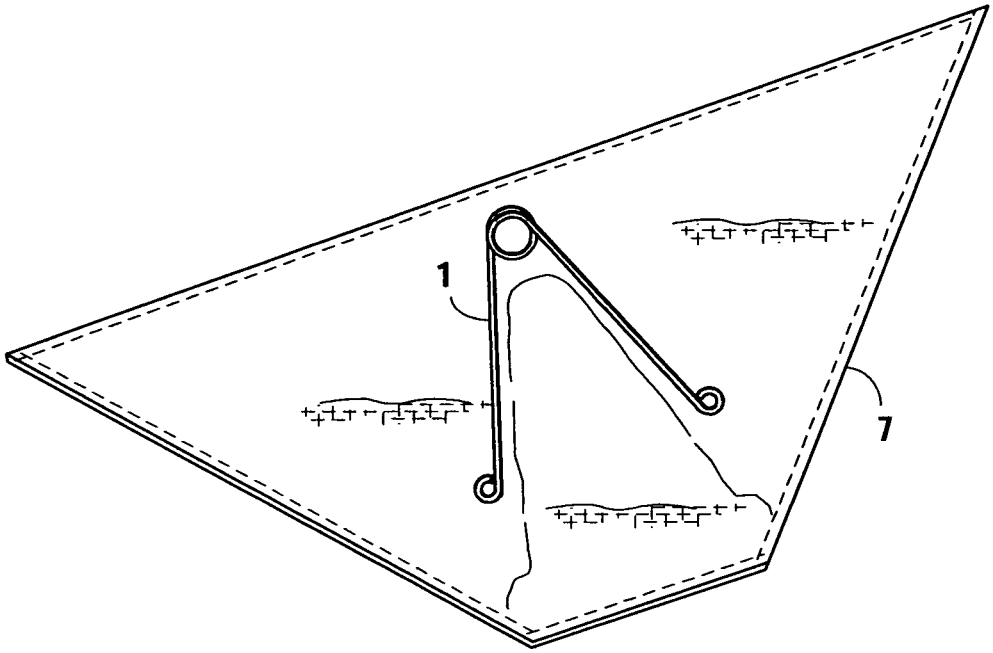

FIG. 3*a* is a drawing showing the orientation of the fishtail fastener spring on a sturdy fabric.

Figure 3B:
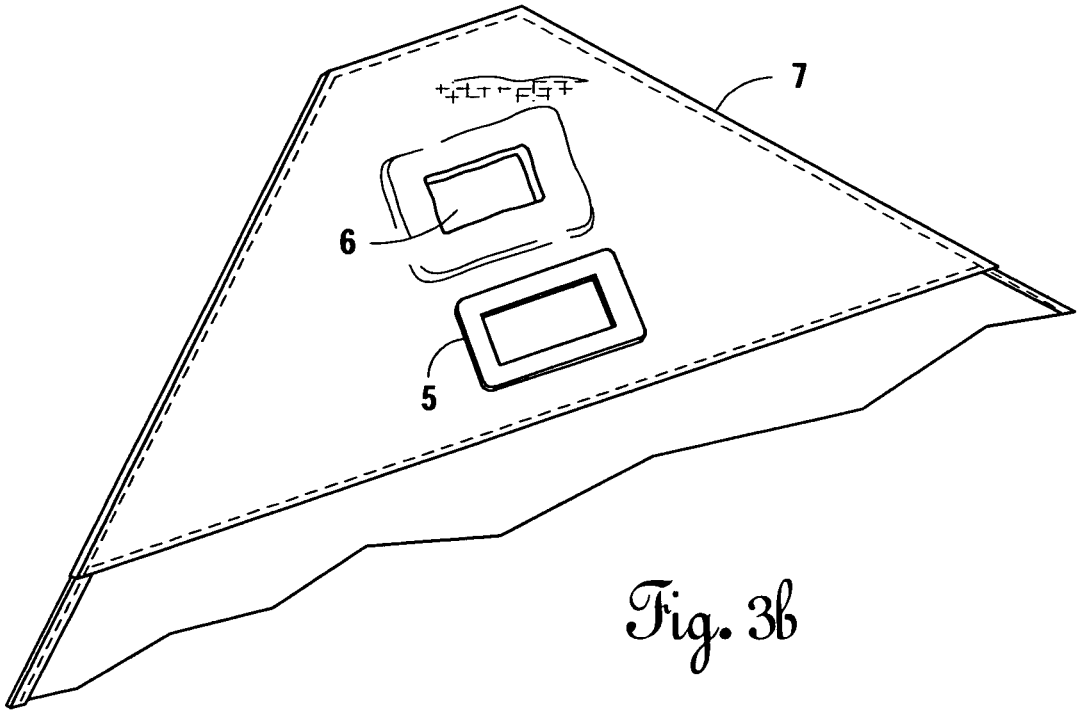

FIG. 3*b* is a drawing showing the orientation of the fishtail fastener spring receiver on a sturdy fabric.

Figure 4A:
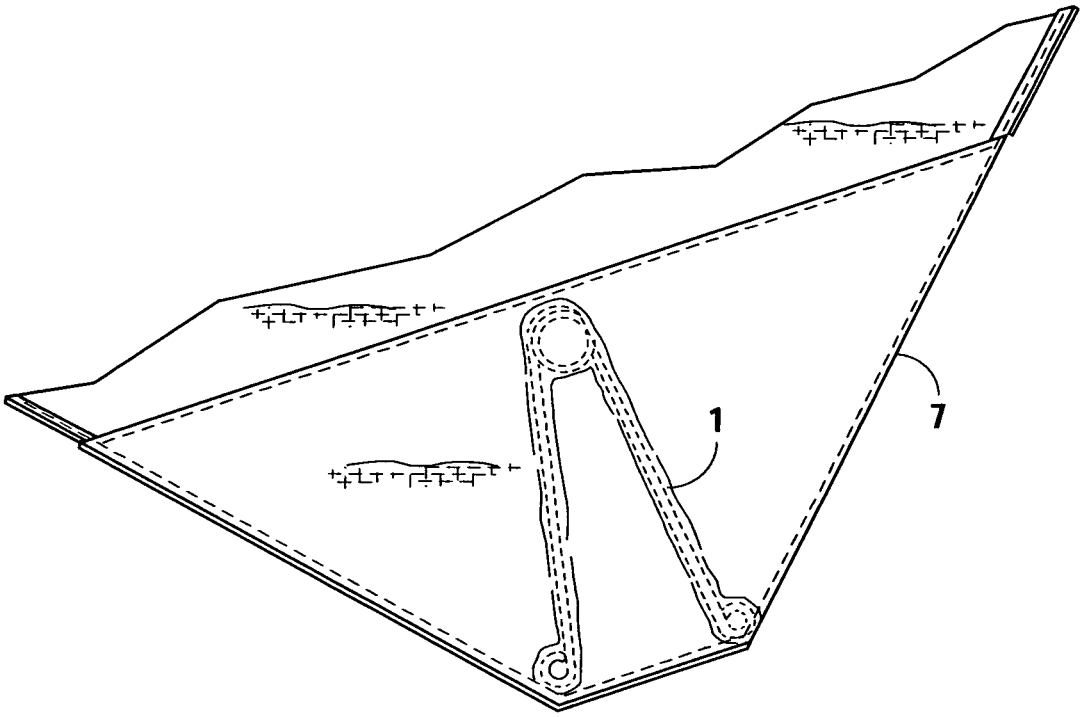

FIG. 4*a* is a drawing showing the fishtail fastener spring embedded in a sturdy fabric.

Figure 4B:
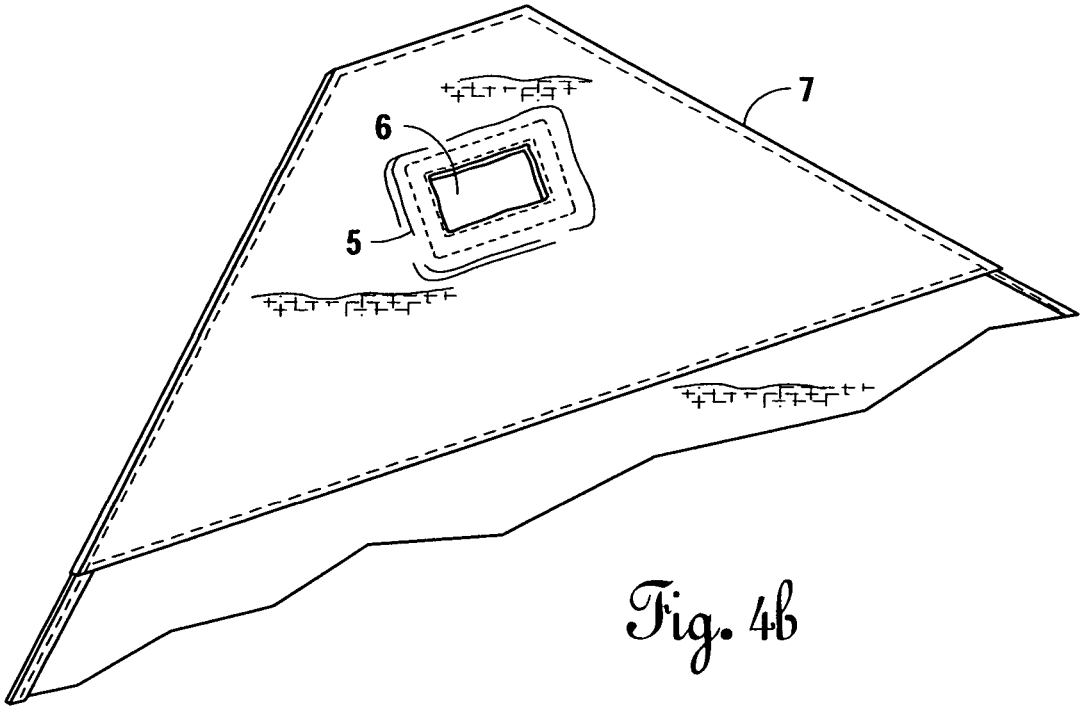

FIG. 4*b* is a drawing showing the fishtail fastener spring receiver embedded in a sturdy fabric.

Figure 5:
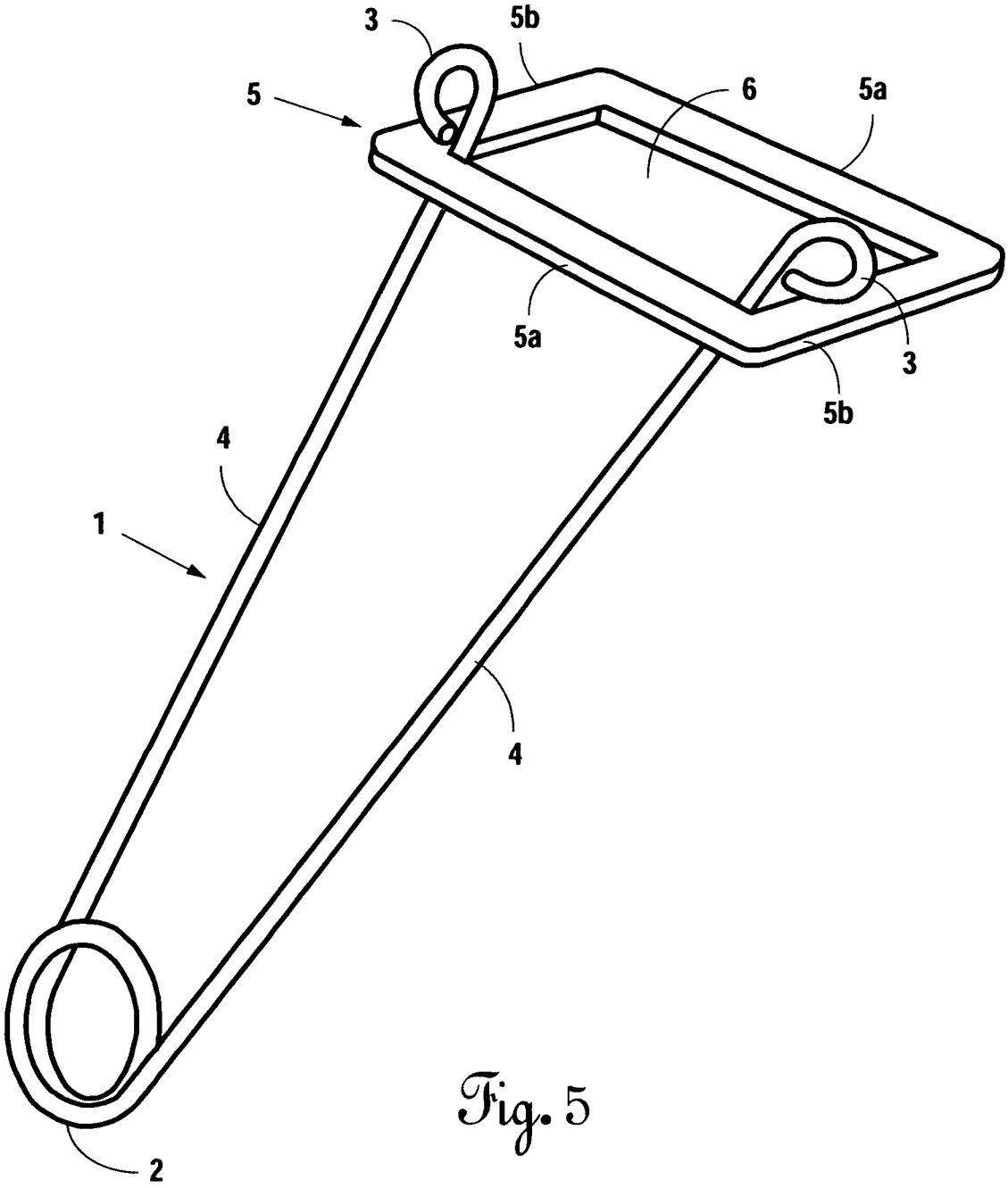

FIG. 5 shows the fishtail fastener spring inserted into the fishtail fastener spring receiver when not embedded in the sturdy fabric.

Figure 6:
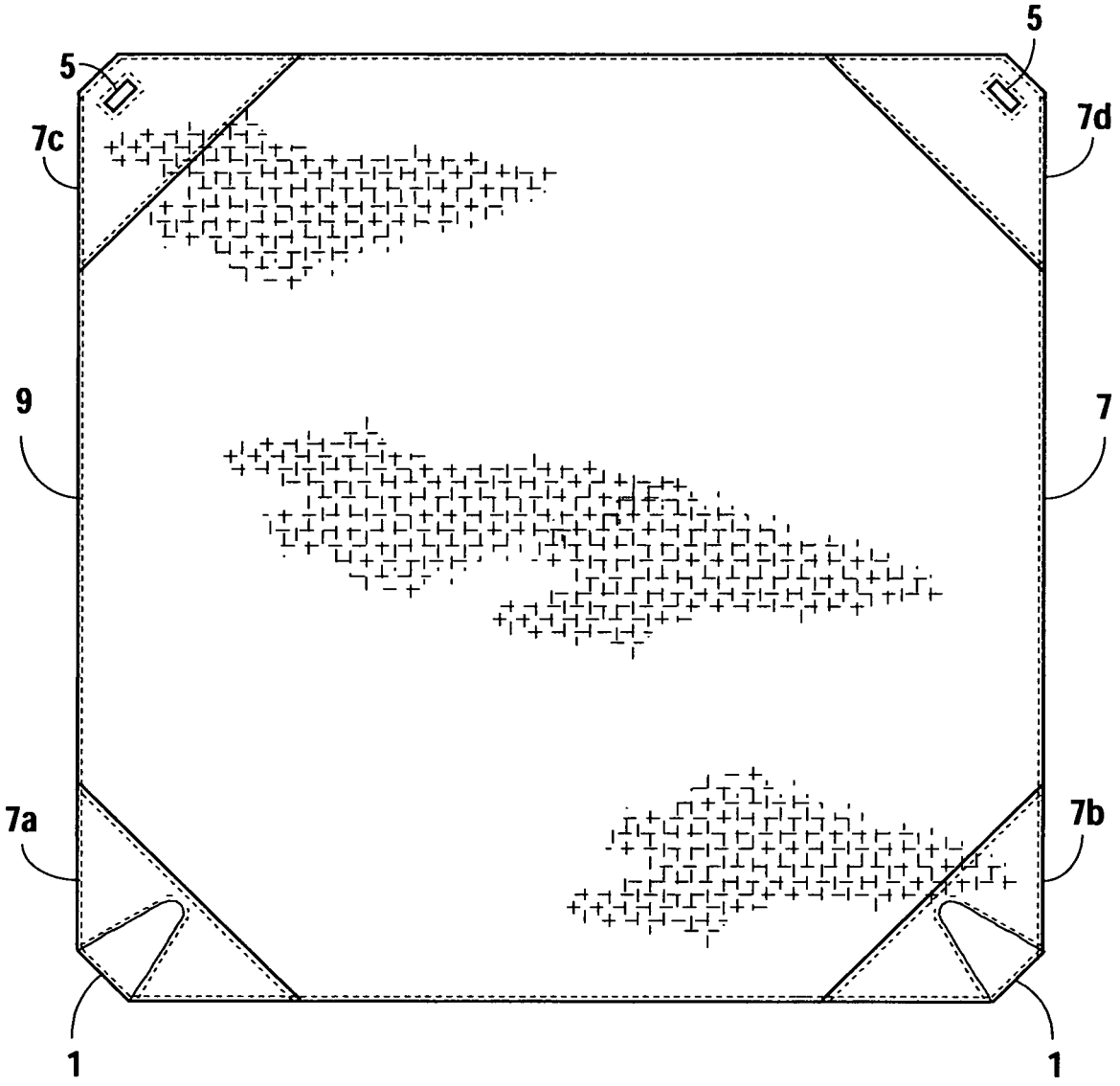

FIG. 6 shows the orientation of the fishtail fastener springs and fishtail fastener spring receivers in a sturdy fabric.

Figure 7:
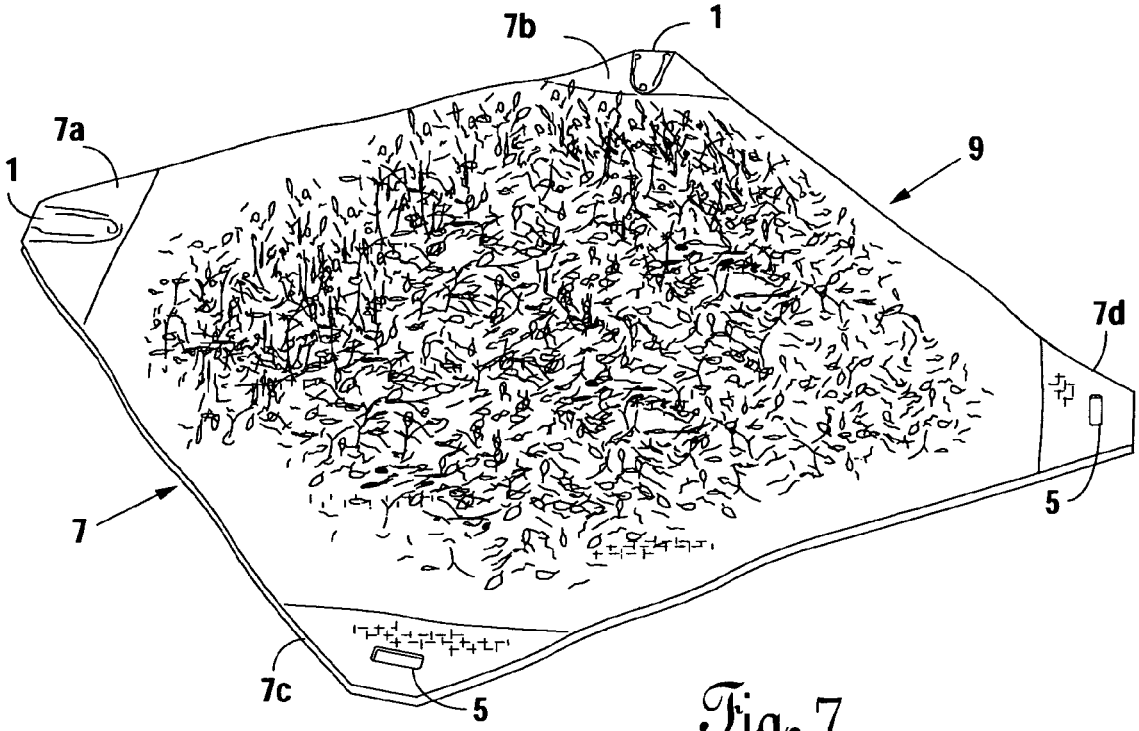

FIG. 7 shows the sturdy fabric containing fishtail fastener springs and fishtail fastener spring receivers used to gather grass clippings.

Figure 8:
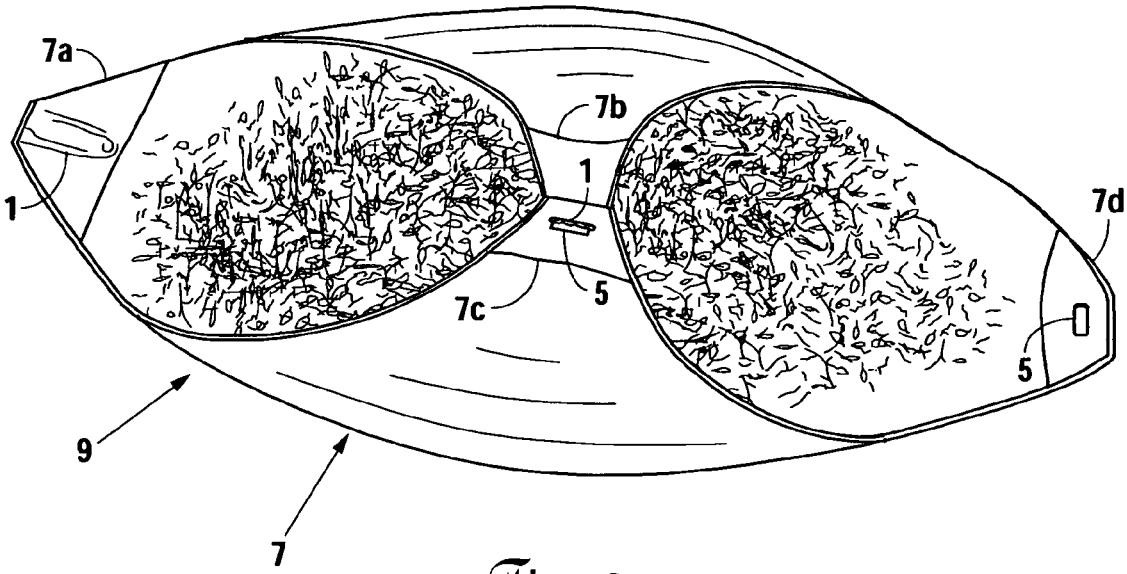

FIG. 8 shows the joining of opposed fishtail fastener spring and fishtail fastener spring receiver embedded in a sturdy fabric used to encase grass clippings.

Figure 9:
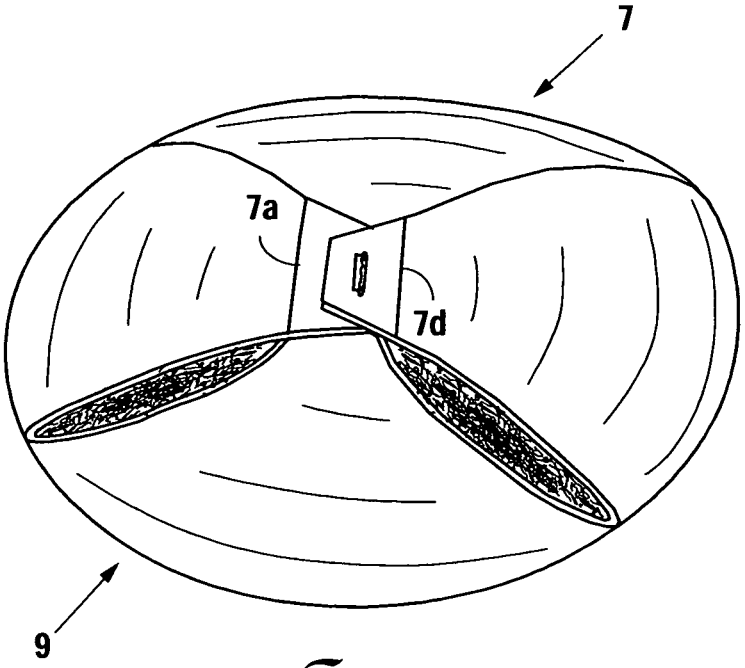

FIG. 9 shows the joining of the remaining opposed fishtail fastener spring and fishtail fastener spring receiver embedded in a sturdy fabric used to encase grass clippings.

Figure 10:
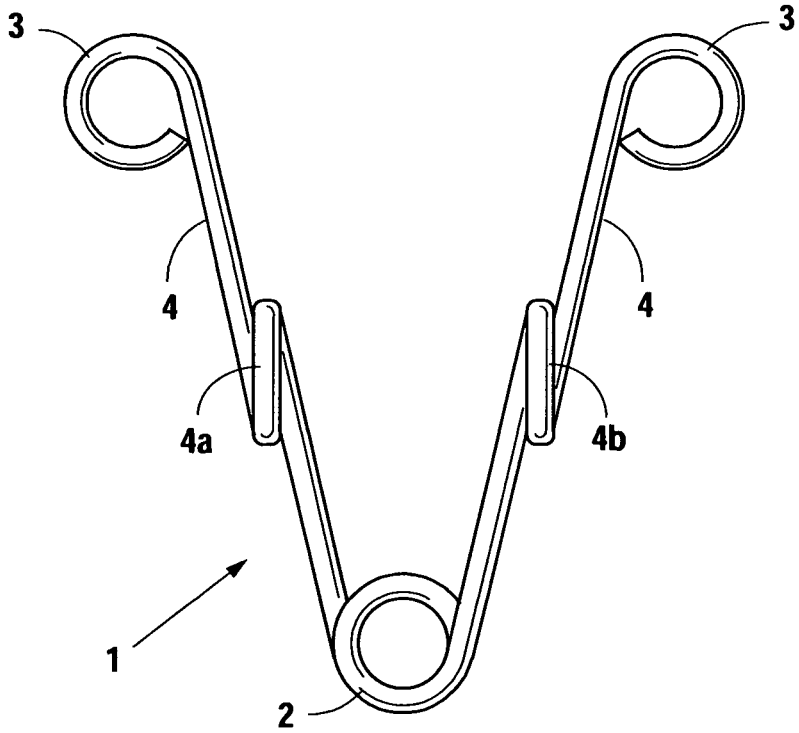

FIG. 10 shows a smaller fishtail fastener spring with configured so as to permit easy grasping.

DETAILED DESCRIPTION OF THE INVENTION

Figure 1:
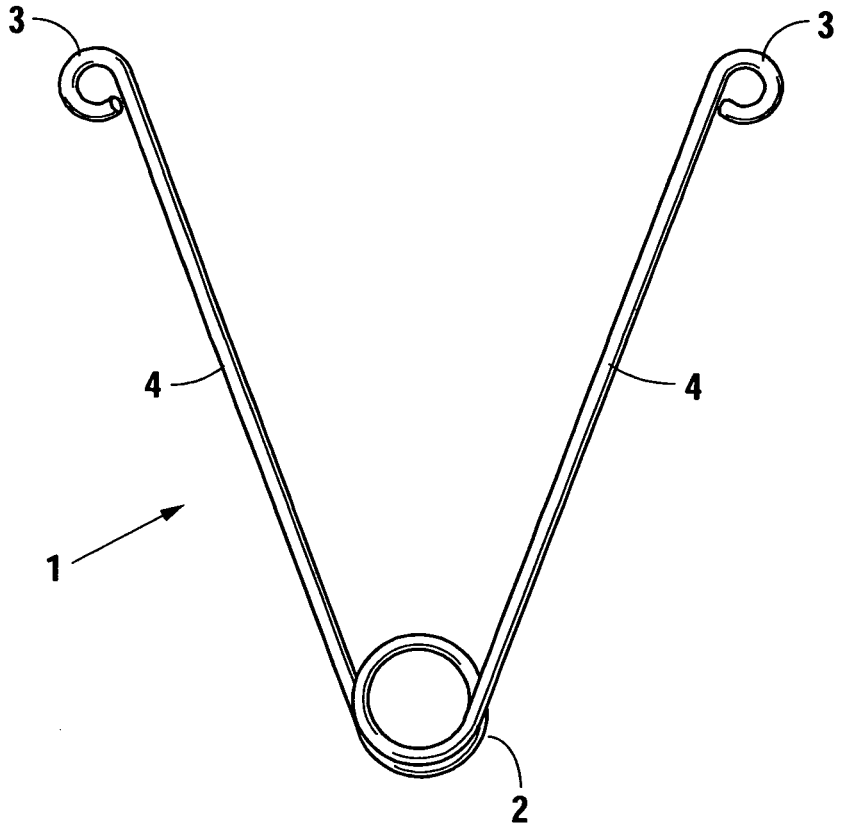
FIG. 1 is a drawing of the fishtail fastener spring.
Figure 2:
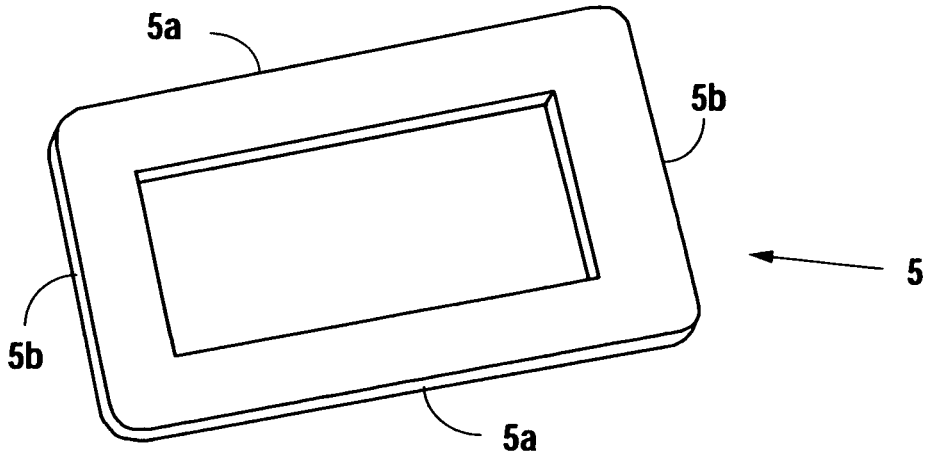
FIG. 2 is a drawing of the fishtail fastener spring receiver.

The invention and related embodiments disclosed herein is an apparatus by which sturdy fabric may be joined together so as to encase objects or items to be contained or secured. Specifically, the invention and related embodiments consist of a "V" shaped fishtail fastener spring and a fishtail fastener spring receiver both of which are embedded in the sturdy fabric to be fastened together. As shown in FIG. 1 the fishtail fastener spring 1 consists of a spring 2 to which two circular stops 3 are attached by two lateral struts 4 constructed from a variety of strong metal, plastics and the like. The fishtail fastener spring receiver 5 is shown in FIG. 2. The fishtail fastener spring receiver 5 is rectangular in shape and consists of two parallel long members 5*a* connected by two parallel shorter lateral members 5*b*. The fishtail fastener spring receiver 5 may be constructed from a variety of strong metals, plastics and the like.

The fishtail fastener spring 1 and the fishtail fastener spring receiver 5 are to be embedded into a sturdy fabric 7 to be fastened together as shown in FIG. 3. The sturdy fabric 7 is integrated around the interior of the fishtail fastener spring receiver 5 to form an opening 6. The orientation of the fishtail fastener spring 1, while not shown in FIG. 3 is demonstrated by placing a fishtail fastener spring 1 on top of the approximate location of the fishtail fastener spring 1 embedded into the sturdy fabric 7. The orientation of the fishtail fastener spring receiver 5 is demonstrated by placing a fishtail fastener spring receiver 1 on top of the approximate location of the fishtail fastener spring receiver 5 to be embedded into the sturdy fabric 7.

The fishtail fastener spring 1 and the fishtail fastener spring receiver 5 are embedded into a sturdy fabric 7 as shown in FIGS. 4*a* and 4*b*. The fishtail fastener spring 1 is embedded into the sturdy fabric 7 in such an orientation so that the spring 2 is located toward the interior of the sturdy fabric 7 and the two circular stops 3 are located toward the outer edge of the sturdy fabric 7.

In order to fasten the pieces of sturdy fabric 7 together, the two circular stops 3 of the fishtail fastener spring 1 are inserted into the integrated opening 6 within the sturdy fabric 7 from the interior of the fishtail fastener spring receiver 5 by compressing the spring 2 by squeezing on the lateral struts 4 until the circular stops 3 can pass through the opening 6 as shown in FIG. 5. The circular stops 3 on the fishtail spring 1 prevent the pieces of sturdy fabric 7 from becoming unfastened by locking against the lateral members 5*b* of the fishtail fastener spring receiver 5. In order to unfasten the pieces of sturdy fabric 7 from each other, the spring 2 of the fishtail fastener spring 1 is compressed by squeezing the lateral struts 4 of the fishtail fastener spring 1 until the circular stops 3 are free from the lateral members 5*b* of the fishtail fastener spring receiver 5 and able to be pulled through the integrated opening 6 of the sturdy fabric 7 from the interior of the fishtail fastener spring receiver 5.

The orientation of the fishtail fastener spring 1 following insertion of the circular stops 3 through the opening 6 in the fishtail fastener spring receiver 5 and the locking of the circular stops 3 against the lateral members 5*b* of the fishtail fastener spring receiver 5 is more clearly shown in FIG. 5 because the fishtail fastener spring 1 and fishtail fastener spring receiver 5 have been removed from the fabric 7 for demonstration purposes.

The orientation of the fishtail fastener springs 1 and the fishtail fastener spring receivers 5 into the sturdy fabric 7 is shown in FIGS. 6 and 7. Two fishtail fastener springs 1 are embedded singly into the sturdy fabric 7 at two adjacent corners 7*a*, 7*b* of the sturdy fabric 7. A fishtail fastener receiver 5 is embedded into the sturdy fabric 7 at the each of the corners 7*c*, 7*d* located opposite to the location of the fishtail fastener springs 1.

In order to close the bag 9 constructed of sturdy fabric 7, the circular stops 3 of the fishtail fastener spring 1 from a corner 7*b* opposite the corner 7*c* of the bag 9 into which the fishtail fastener spring receiver 7*c* is embedded is inserted into the opening 6 of the fishtail fastener spring receiver 5 drawing together the two opposing corners 7*b*, 7*c* of the bag 9.

Closing the bag 9 constructed from sturdy fabric 7 is completed by joining together the remaining two opposing corners 7*a* and 7*d* of the bag 9. The circular stops 3 of the fishtail fastener spring 1 from corner 7*a* opposite the corner 7*d* into which the fishtail fastener spring receiver 5 is embedded is inserted into the opening 6 of the fishtail fastener spring receiver 5 drawing together the remaining two opposing corners 7*a* and 7*d* of the bag 9.

The fishtail fastener spring 1 may be constructed in smaller sizes for different applications. A smaller size of fishtail fastener spring 1 needs an adaptation in order to conveniently squeeze the lateral struts 4 together to enable the circular stops 3 to fit into the opening of the fishtail fastener spring receiver 6. The adaptation shown in FIG. 10 consists of finger holds 4*a*, 4*b* constructed into the lateral struts 4 to enable easy grasping and squeezing of the fishtail fastener spring 1.

The invention disclosed herein is susceptible to many embodiments. First, and without limitation, the fishtail fastener spring may be constructed in various sizes to accommodate different sized jobs to be performed and applications thereof. The sturdy fabric into which the fishtail fastener spring and fishtail fastener spring receiver are embedded may be of different compositions, such as canvas, denim, sturdy artificial fabrics and the like. The fabric can frame a more durable and attachable material like plastic and stay held by the fishtail fastener spring. The fabric can be constructed in various sizes and shapes depending on the objects to be secured. For example, a square fabric employing two fishtail fastener springs with a fishtail fastener spring in one corner of the fabric and its corresponding fishtail fastener spring receiver in the opposing corner could be used for hauling leaves, trash, materials, sporting equipment and other items. Another example would be a strap in which the fishtail fastener spring was embedded in the fabric at one end and the fishtail fastener spring receiver would be embedded in the opposite end of the strap. Insertion of the fishtail fastener spring into the fishtail fastener spring receiver would form a strap which would be useful in containing items such as branches, tarps and poles, seat cushions, baseball bats, suspenders, or hockey sticks. Alternatively, the fishtail fastener spring receiver could be welded to the frame of a trailer or bed of a truck. The strap could then be used to secure a boat cover to its trailer or secure items loaded on to the back of a truck bed or trailer for safe hauling. Fishtail fasteners used in clothing, quilts, window treatments, curtains, home décor items, and personal accessories (such as belts) attaches fabric pieces together when integrated into the edges of items to be hung or fastened. Fishtail fasteners are quick and easy to connect and disconnect. Fishtail fasteners used to open and close a fabric loop allow the installation and removal of window treatments and curtains without the need to detach the holding curtain rod. Other uses include holding panels of fabric to provide outdoor shading or privacy, display of quilts, fabric art, and protective fabric covering. Fishtail fasteners are used in place of other fastening devices such as buttons, clasps, d-rings, and buckles. Fishtail fasteners may be used to secure any sewn or completed fabric creation to hold in place or to connect pieces. All other embodiments of this fishtail fastener invention disclosed herein which reasonably flow from this disclosure are included herein.

I claim:

1. A fastening mechanism embedded into a sturdy fabric comprising:

a fastener spring from which two lateral struts extend at approximately a 45 degree angle from said fastener spring, each of which said lateral struts has attached at the end of said lateral strut distal from the spring a circular stop;

a fastener spring receiver composed of two parallel horizontal long members and connected by two parallel vertical short members forming a rectangle with an opening formed by said horizontal long members and said vertical short members;

Whereby, upon compressing said two lateral struts toward each other, said circular stops are drawn toward each other and may be inserted into said opening of said fastener spring receiver and held securely in place when the compression on said lateral struts is relieved.

2. The fastener defined in claim 1 wherein said fabric may be selected from a group comprising:

canvas or denim.

3. A fabric bag into which a plurality of fastener springs and fastener spring receivers are-ace embedded into opposite corners of said bag each of which comprising;

a fastener spring from which two lateral struts extend at approximately a 45 degree angle from said fastener spring, each of which said lateral struts has attached at the end of said lateral strut distal from the spring a circular stop;

a fastener spring receiver constructed from two parallel horizontal long members and connected by two parallel vertical short members forming a rectangle with an opening formed by said horizontal long members and said vertical short members;

Whereby said bag is closed by compressing said lateral struts toward each other drawing together said circular stops permitting insertion of said circular stops into said fastener receivers and thereby securely connecting opposite corners of said bag when the compression on said lateral struts is relieved.

4. A fastener for a belt or strap comprising:

a fastener spring embedded in one end of said belt or strap from which two lateral struts extend at approximately a 45 degree angle from said fastener spring, each of which said lateral struts has attached at the end of said lateral strut distal from the spring a circular stop;

a fastener spring receiver embedded in the distal end of said belt or strap from said fastener spring constructed from two parallel horizontal long members and connected by two parallel vertical short members forming a rectangle with an opening formed by said horizontal long members and said vertical short members;

Whereby the ends of said belt or strap are closed by compressing said lateral struts toward each other drawing together said circular stops permitting insertion of said circular stops into opening of said fastener receiver, thereby securely connecting opposite ends of said belt or strap when the compression on said lateral struts is relieved.

* * * * *